US005492496A

United States Patent [19]

Walker

[11] Patent Number: 5,492,496

[45] Date of Patent: Feb. 20, 1996

[54] ABDOMINAL SUPPORT GARMENT

[76] Inventor: Lesa R. Walker, 1700 Stamford La., Austin, Tex. 78703

[21] Appl. No.: 231,136

[22] Filed: Apr. 22, 1994

[51] Int. Cl.[6] ..... A41B 9/00; A41C 1/00

[52] U.S. Cl. ..... 450/155; 2/44; 2/227; 2/406; 602/19

[58] Field of Search ..... 602/19; 128/96.1, 128/106.1, 112.1, 117.1, 120.1, 830; 2/44, 92, 311, 312, 338, 400, 401, 402, 406, 407, 408, 409, 79, 227, 69; 450/155

[56] References Cited

U.S. PATENT DOCUMENTS 4,798,539 1/1989 Henry et al. ..... 224/224 X

*Primary Examiner*—Jeanette E. Chapman

[57] ABSTRACT

A garment (10) provides comforting support to the abdomen when in a reclining position, particularly adapted for wear by pregnant women, however may also be worn by other individuals in need of abdominal support as described. The garment (10) includes a non-padded, expandable front panel (12) attached to two side panels (14,16) constructed of layered padding (34,36,38,40,42) encased in soft material (30,32). The side panels (14,16) extend into back flaps (18,20) that secure the garment (10) at the back of the wearer. The back flaps (18,20) include adjustable fastening means (44,46,48). The layered padding (34,36,38,40,42) in the side panels (14,16) provides more cushioning support toward the front or anterior part of the abdomen. In one embodiment, the front panel (12) is expandable and gently gathered at the top and bottom (22,24) of the front panel (12) to allow automatic adjustment to increases in abdominal girth and changes in body contour. In other embodiments the garment (10) may include pockets (52,54) sewn into the inside front (12) and side panels (14,16) that are capable of holding moisturizing means next to the abdomen to moisten dry, pruritic, stretched abdominal skin.

8 Claims, 2 Drawing Sheets

FIG. 4
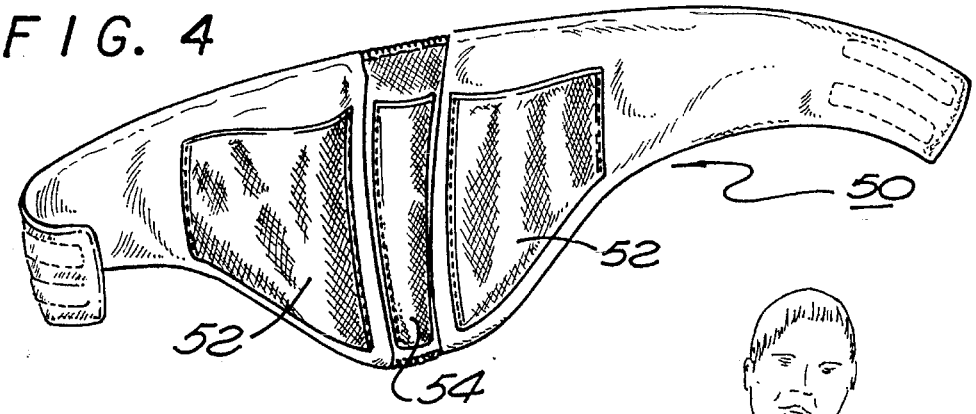
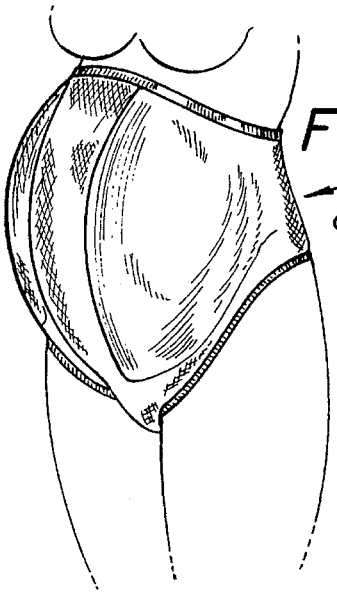
FIG. 5
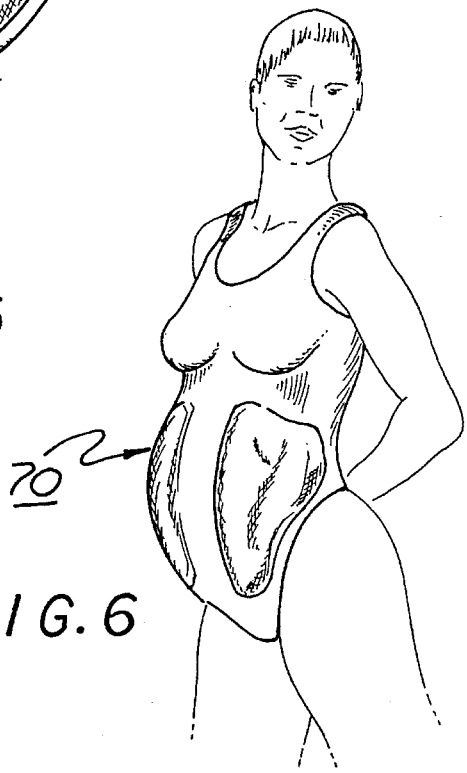
FIG. 6
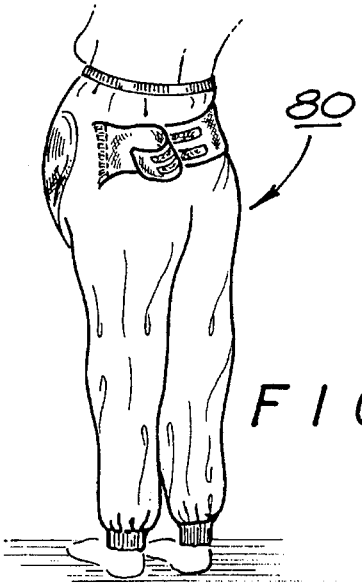
FIG. 7
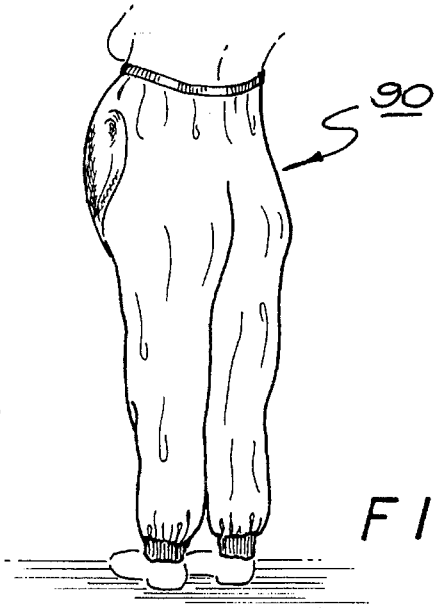
FIG. 8

ABDOMINAL SUPPORT GARMENT

BACKGROUND-FIELD OF INVENTION

This invention relates generally to support-providing wearing apparel and more specifically to such apparel used for abdominal support in the reclining position, more specifically adapted for pregnant women, however, not limited in use to pregnant women.

BACKGROUND-DESCRIPTION OF PRIOR ART

It is common for pregnant women to have discomfort in the mid to latter stages of pregnancy when attempting to rest, sleep, or exercize while in the reclining position and turned on their side. Frequently, pillows are used to provide support to the abdomen to relieve such discomfort. Pillows hinder free movement and potentially distance a woman from her partner (spouse). Pillows are awkward to move and shift when the woman changes positions from side to side. This invention removes these disadvantages associated with pillows.

Other prior art exists; however, these are not structured to provide optimum comfort and do not incorporate an expandable front panel that automatically adjusts to increasing abdominal girth and contour changes without manual adjustment. The best prior art known to Applicant is shown in U.S. Pat. Nos. D218,586; 182,019; 344,065; 398,199; 517,941; 697,164; 898,093; 974,045; 1,175,991; 2,824,565; 2,878,812; 3,315,670; 3,434,469; 4,108,149; 4,472,839; 4,525,879; 4,746,318; 4,836,824; 4,976,653; 5,016,291; 5,109,421; and U.K. Pat. No. 2,242,611.

Of these prior art patents referred to the most pertinent are U.S. Pat. No. 3,315,670 (Inventor: J.G. Fumea; Issue Date: Apr. 25, 1967) and U.K. Pat. No. 2,242,611 (Inventors: D. Benussi and A. Thake; Issue Date: Sep. 10, 1991). Each of these patents is directed to a structure designed to provide more comfort for women during the latter stages of pregnancy, particularly when lying in the reclining position on their side.

The U.K. Pat. No. 2,242,611 discloses a garment in the form of a supporting cushion, designed to fit across the front of the abdomen, extending from one side to the other and secured in position by straps. The cushion includes compartments which are designed to be filled with a foam material, preferably in the form of beads or pellets of expanded polystyrene. The side panels toward the anterior but not overlying the front of the abdomen would be filled with approximately twice the volume of material contained within the center panel in order to provide support where most needed. Alternatively, the cushion may be inserted into pockets formed in an apron or a T-shirt.

The U.S. Pat. No. 3,315,670 describes a belt which contains a resilient substance such as foam rubber or the like within cloth cover material formed into pads. The pads include an elastic, rear waist band along with appropriate front bands for attaching the belt on the wearer. The pads are situated on either side of the wearer so as to provide support to the abdomen in the reclining position.

OBJECTS AND ADVANTAGES

The garment described herein improves upon the prior art structures described above by providing a non-padded, expandable front panel made of soft material to allow fullness across the abdomen with room to accommodate abdominal expansion. In addition, bands of resilient material such as elastic or other such gathering means are sewn across the upper and lower edges of the front panel to allow the garment to fit the abdominal contour and expand as needed.

The front panel is sewn along its longitudinal edges to two side panels made of soft material encasing layers of padding (the padding made of material with similar properties to that found in polyester batting material). The garment's front and side panels cover the entire abdominal area of the individual for an increased area of comfort over that of prior art.

The two side panels extend into padded back flaps that fasten in the back with adjustable fasteners with the same properties as those found in Velcro (reg. TM). The application of the garment is simplified into a one step wrap-around and simple overlap of the back panels to fasten in the back. Also, as mentioned above, due to the expandable front panel, the garment automatically adjusts to changes in the wearer's abdominal girth and contour without the need for manual adjustment.

In addition to these advantages, the garment is structured so that it allows pockets (up to the full width of the panels) to be incorporated on the inside surface of the front and side panels. The inside pocket material can be made of permeable, stretchable or non-stretchable material to hold moisturizing material or means next to the abdomen to moisturize dry, pruritic, and/or stretched abdominal skin, potentially for extended periods of time, e.g. overnight, to soothe and relieve discomfort derived from such symptoms.

Further objects and advantages of the invention will become apparent from a consideration of the drawings and ensuing dgscription of it.

BRIEF DESCRIPTION OF THE DRAWINGS

FIG. 4 is a perspective view of a second embodiment of the garment, incorporating the inside pockets;

FIG. 5 is a perspective view of a third embodiment of the garment incorporated into underpants;

FIG. 6 is a perspective view of a fourth embodiment of the garment incorporated into a leotard;

FIG. 7 is a perspective view of a fifth embodiment of the garment incorporated into sweatpants (or pajama pants) with back flaps; and FIG. 8 is a perspective view of a sixth embodiment of the garment incorporated into sweatpants (or pajama pants) without back flaps.

Reference Numerals In Drawings

Figure 1:
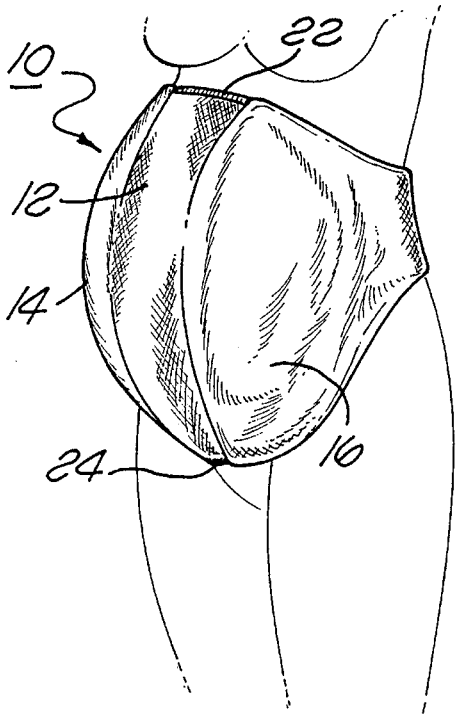
FIG. 1 is a front perspective view of the garment of the present invention shown on the torso of a pregnant woman.

| | |
|---|---|
| 10 garment | 12 front panel |
| 14 side panel (right) | 16 side panel (left) |
| 18 back flap (right) | 20 back flap (left) |
| 22 resilient band (upper) | 24 resilient band (lower) |
| 26 front panel edge (left) | 28 front panel edge (right) |
| 30 outer side panel material | 32 inner side panel material |
| 34–42 padding layers | 44 fastening |
| 46 loop fastening material | 48 hook fastening material |
| 50 second embodiment | 52 side panel inside pockets |

-continued

| Reference Numerals In Drawings | |
|---|---|
| 54 front panel inside pocket | 60 third embodiment |
| 70 fourth embodiment | 80 fifth embodiment |
| 90 sixth embodiment | |

DESCRIPTION OF THE PREFERRED EMBODIMENT

Figure 2:
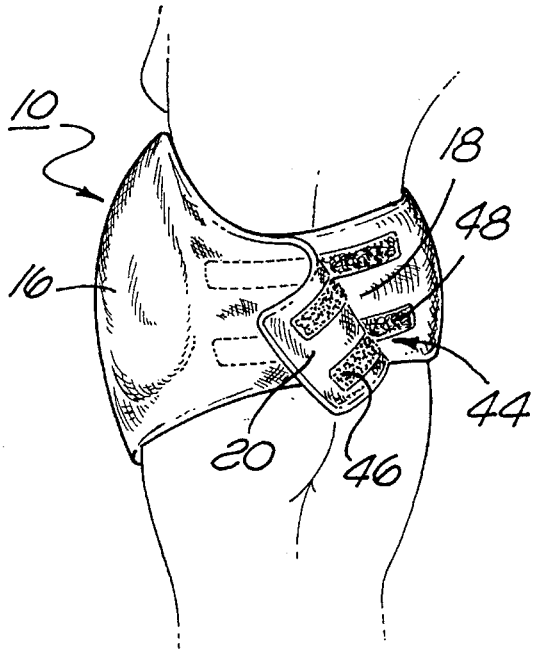
FIG. 2 is a rear perspective view of the garment with fastening means shown partially attached.

A typical embodiment of the garment of the present invention is illustrated in FIG. 1 (front perspective view) and FIG. 2 (rear perspective view). As shown in the drawings, FIGS. 1 and 2, there is provided a garment 10 which is constructed to overlie the front and sides of the abdomen (FIG. 1) and fasten in the back (FIG. 2).

In FIG. 1 garment 10 is shown to consist of a front panel 12 attached to two padded side panels 14 and 16. Side panels 14 and 16 extend into padded back flaps 18 and 20 that overlap and fasten at the back of the wearer as illustrated in FIG. 2.

Front panel 12 is not padded and is made of soft, lightweight, preferably breathable material that, if stretchable, is resilient and able to resume its original shape after repeated stretching. If stretchable, the material should have substantial stretch in the horizontal direction and less in the vertical direction. A variety of types of soft materials may be used, depending on the look, feel, and degree of warmth and stretchability desired. Materials may include 100% cotton knit, polyester/cotton blends, Rayon/cotton blends, Acrylic/Lycra blends for a leotard-like effect, Nylon/Lycra blends for an exercize outfit effect, or eyelet material (a polyester/cotton blend) for increased air flow to the abdomen. The types of material that can be used are not limited to those listed above. Preferably, the cloth is machine washable. The cloth does not have to be stretchable.

FIG. 1 illustrates that front panel 12 has bands of soft resilient material (with the properties of elastic) 22 and 24 sewn into the upper and lower edges which gently gather in the upper and lower edges of front panel 12 and allow the entire garment 10 to provide a more contoured fit. Front panel 12 is patterned such that the width allows for expansion of abdominal girth.

As illustrated in FIG. 1 front panel 12 covers the abdomen of the wearer, extending from several (approximately 12–18) centimeters (5–7 inches) below the nipple line (just below the "bra-line" in women) to just above the pubic area. Front panel 12 exists in a loosely gathered state over a small abdominal girth. The front panel's gathers decrease and resilient material 22 and 24 at the upper and lower edges expands as the abdominal girth gets larger. If the material of front panel 12 is stretchable, even more expansion of front panel 12 is possible in response to increasing abdominal girth. The size of front panel 12 can be adapted to fit a variety of large to small body builds.

Figure 3:
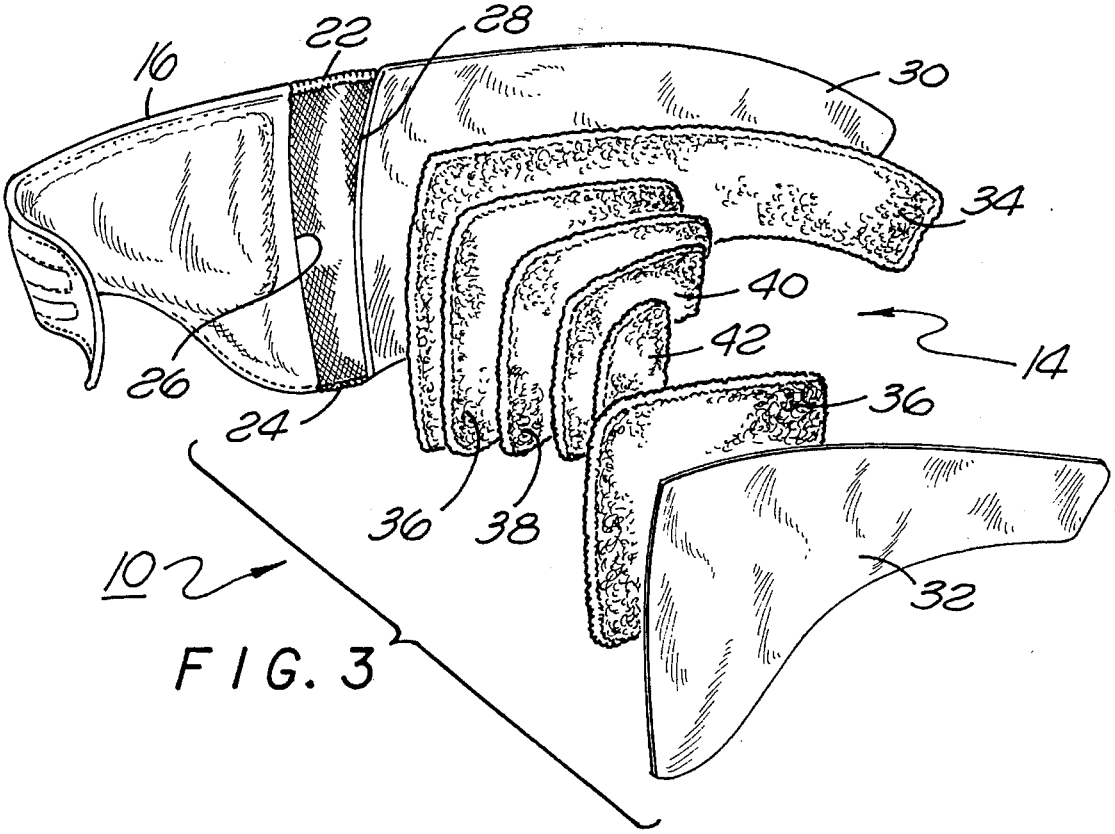
FIG. 3 is a perspective view (shown from the inside) with the right side exploded to better illustrate the internal padding system.

FIG. 3 represents a perspective view (shown from the inside) with the right side exploded to better illustrate the internal padding system. Front panel 12 is attached along its longitudinal edges 26 and 28 to equal sized padded side panels 14 and 16. As shown in FIG. 3 side panels 14 and 16 are identically patterned and consist of layers of padding 34, 36, 38, 40, and 42 encased in soft material 30 and 32. The material can be similar or identical to that of front panel 12 or can be made out of other material such as Luxury Fleece that provides a fuzzy surface for increased warmth, or flannel, or satin. Again, the types of materials are not limited to those materials described above. As with front panel 12, it is preferable that side panel material 30 and 32 be machine washable. It does not have to be stretchable.

In side panels 14 and 16 layers of padding 34, 36, 38, 40, and 42 are of different size and are gradated from largest to smallest such that each successive layer is smaller than the last and fits inside the parameters of the prior layer. Layers 34, 36, 38, 40, and 42 are placed on top of each other so that the greatest thickness of the combined layers is found toward the anterior portion of side panels 14 and 16, to provide most support to the abdomen in that area. A repeated layer of large sized padding 36 is added to cover the stack of large to small layered padding 34, 36, 38, 40, and 42 to ensure a feeling of smoothness on both the inside and outside surfaces of side panels 14 and 16.

It is suggested that layers of padding 34, 36, 38, 40, and 42 have the same properties as polyester batting material. Softer padding is used for outer layers of padding 34 and 36 and stiffer padding with extra loft is used for inner layers 38, 40, and 42. The types of padding that have been found useful include Dacron Polyester layer-built batting (soft) and "Extra-Loft" batting made out of bonded polyester (resin treated polyester fiber) (stiff), however, the padding is not restricted to the batting types described.

As shown in FIGS. 1 and 3 the largest surface area of side panels 14 and 16 overlies the sides of the wearer and some of the front of the abdomen attaching along longitudinal edges 26 and 28 of front panel 12. FIG. 1 illustrates that side panels 14 and 16 extend from several (approximately 12–18) centimeters (5–7 inches) below the nipple line in the wearer (just below the "bra-line" in women) to just over the top of the pelvis at the side of the body. FIG. 1 shows that the lower edges of side panels 14 and 16 slope downward to just above the pubic area as side panels 14 and 16 come to the front of the body to attach with front panel 12. FIGS. 2 and 3 illustrate that padded side panels 14 and 16 extend in a continuous fashion into narrower padded back flaps 18 and 20. Side panels 14 and 16 with extended back flaps 18 and 20 can be sized to adapt to a variety of large to small body builds.

FIG. 2 shows back flaps 18 and 20 fastening at the back of the wearer with overlapping strips of adjustable fastening material 44, 46, and 48. Adjustable fastening material 44, 46, and 48 is made of two pairs of self-fastening complementary strips 46 and 48. Strips 48 have hook-like projections and strips 46 have a looped or fuzz-like matt surface. Thus, as illustrated in FIG. 2, upon pressing these two opposed pairs of strips 46 and 48 together they become fastened. This type of fastening arrangement 44, 46, and 48 is known in the market under the name Velcro (reg. TM) and may be easily adjusted by the wearer as is well known.

As shown in FIG. 2 back flap 20 that overlies back flap 18 has two parallel and equal length loop or fuzz-like matt strips 46 sewn on the inside of flap 20. Strips 46 fasten to two complementary hook-like projection strips 48 sewn to the outside of inner back flap 18 in order to fasten garment 10 and help fit the garment securely to the wearer while retaining ease of adjustment.

FIG. 4 represents another or second embodiment 50. Embodiment 50, in addition to the attributes included in the above description of the preferred embodiment of the garment (FIGS. 1, 2, and 3), has one or more pockets 52 and 54 of permeable, breathable, lightweight, preferrably machine washable material sewn into the inside of front panel 12 and side panels 14 and 16. Pockets 52 and 54 can hold lotion-saturated material or other such moisturizing means next to dry, pruritic, and/or stretched or irritated abdominal skin (potentially for extended periods of time, e.g. overnight).

Although preferred embodiment 10 as explained and shown in the drawings (FIGS. 1, 2, and 3) is a stand alone garment, it is clear to anyone normally skilled in the art that further embodiments of the garment can include incorporating the garment into other body wear, allowing a variety of styles. Examples of other embodiments as illustrated in FIGS. 5, 6, 7, and 8 include but are not limited to the garment built into underpants (with crotch) that extend up over the abdomen 60 (FIG. 5), into leotards 70 (FIG. 6) for cushioned support during exercize, and into sweatpants or pajama pants (that extend up over the abdomen) 80 and 90 (FIGS. 7 and 8) for exercize or sleeping comfort.

When the invention is built into other garments (FIGS. 5, 6, 7, and 8), front panel 12 and side panels 14 and 16 shown in FIGS. 1 and 2 can be incorporated into the body of the other garments (FIGS. 5, 6, 7, and 8) and back flaps 18 and 20 shown in FIG. 2 can remain free of the body such that the back flaps can still overlap and fasten in the back as illustrated in FIG. 7. Or, as in another embodiment 90 shown in FIG. 8, all parts of the invention (front and side panels, including back flaps) can be incorporated into the body of the other garment with removal of the strips of adjustable fastening material in the back flaps, allowing the fit of the invention to coincide more with that of the other garment in the back.

SUMMARY, RAMIFICATIONS, AND SCOPE

The preferred embodiment describes an abdominal support garment that provides comforting support to the abdomen in the reclining position, particularly adapted for pregnant women, but not limited in use to pregnant women. The garment has been designed for maximum ease in application. With a simple one-step movement the garment can be put on or taken off. The garment can be placed over undergarments or other clothing or directly next to the body. The expandable non-padded front panel with bands of resilient material at the upper and lower edges, in conjunction with the fastening of the back flaps, facilitate optimal adjustment to increases in abdominal girth and improve fit to the contour of the body as compared to prior art. Also, the garment covers a majority of the abdominal area with layered padding in the side panels for increased comfort.

The preferred embodiment is able to be modified to include interior pockets placed inside the front and side panels. The pockets can be made of permeable material for the purpose of holding lotion-saturated material or other such moisturizing means next to the abdomen in an effort to reduce dryness, pruritus, and discomfort often associated with stretched abdominal skin.

These advantages in use and purpose of the garment make it a significant improvement over prior art. The garment can be used by pregnant women (or other individuals in need of abdominal cushioned support) when resting, sleeping, exercizing (including La Maze exercizes), and during labor if desired.

Although the description of the preferred embodiment contains many specificities, these should not be construed as limiting the scope of the invention but as merely providing illustrations of the presently preferred embodiment of this invention. As discussed above, the garment does not have to be a stand alone garment. It can be incorporated into other body wear, potentially representing numerous presentations and styles.

What is claimed is:

1. A support garment covering the front and sides of the abdomen with means to fasten around the back which provides comfort to the abdomen when an individual is in a reclining position, particularly adapted, but not exclusively, for the use of pregnant women and which comprises:

a. an expandable front panel having upper and lower edges and longitudinal sides; said front panel is not padded and is made of soft material and constructed of a material which allows fullness across the abdomen with room for abdominal expansion;

b. resiliently deformable bands or other such gathering means sewn into the upper and lower edges of said front panel whereby said front panel is gently gathered in at the upper and lower edges, allowing said support garment to fit the body contour and expand as needed;

c. soft, padded side panels of equal size attached along the longitudinal sides of said front panel and extending into back flaps of equal size with means to fasten around the back of the wearer, d. said front and side panels with shape and contour such that most of the front and sides of the abdominal area are covered;

e. layered padding in said side panels is encased in soft material wherein the positioning of said padding in said side panels creates a gradual increase in padding toward the front or anterior part of the abdomen and a smooth contour of said side panels; and f. adjustable fastening means secured to said back flaps for adjustably fastening said support garment at the back of the wearer.

2. The support garment as defined in claim 1 wherein said side panels are continuous with said back flaps and said back flaps have opposing, overlapping ends carrying said adjustable fastening means.

3. The support garment as defined in claim 2 wherein said adjustable fastening means comprises hook and loop fastner material and said fastener material is sewn to each of said back flaps.

4. The support garment as defined in claim 1, further including pockets of lightweight, permeable material are sewn onto an inside of said front and said side panels for the purpose of holding material saturated with lotion or other such moisturizing means next to the abdominal skin.

5. A support garment covering the front and sides of the abdomen with means to fasten around the back which provides comfort to the abdomen when an individual is in a reclining position, particularly adapted, but not exclusively, for the use of pregnant women and which comprises:

a. an expandable front panel having longitudinal sides; said front panel is made of a soft material and constructed of a material which allows fullness across the abdomen with room for abdominal expansion;

b. soft, padded side panels of equal size attached along the longitudinal sides of said front panel and extending into a back of the garment to fasten around the back of the wearer;

c. said front and side panels with shape and contour such that most of the front and sides of the abdominal area are covered;

d. layered padding in said side panels is encased in soft material, wherein the positioning of said padding in said side panels creates a gradual increase in padding toward the front or anterior part of the abdomen and a smooth contour of said side panels;

e. said support garment is incorporated into another garment and said other garment is selected from the group consisting essentially of underpants, sweatpants, pajama pants and leotards.

6. The support garment as described in claim 5 wherein said other garment may extend up and over the abdomen, covering the abdominal area and encircling the body.

7. The support garment as described in claim 6 wherein said back flaps of said support garment are adapted to remain free from the body of said other garment for fastening.

8. A support garment covering the front and sides of the abdomen with means to fasten around the back which provides comfort to the abdomen when an individual is in a reclining position, particularly adapted, but not exclusively, for the use of pregnant women and which comprises:

a. an expandable front panel having longitudinal sides; said front panel is made of a soft material and constructed of a material which allows fullness across the abdomen with room for abdominal expansion;

b. soft, padded side panels of equal size attached along the longitudinal sides of said front panel and extending into back flaps of equal size with means to fasten around the back of the wearer;

c. said front and side panels with shape and contour such that most of the front and sides of the abdominal area are covered;

d. layered padding in said side panels is encased in soft material, wherein the positioning of said padding in said side panels creates a gradual increase in padding toward the front or anterior part of the abdomen and a smooth contour of said side panels;

e. adjustable fastening means secured to said back flaps for adjustably fastening said support garment at a back of the wearer; and f. said support garment is incorporated into another garment and said other garment is selected from the group consisting essentially of underpants, sweatpants, pajama pants and leotards.

* * * * *